US005607113A

United States Patent [19]

McGuffin, Sr. et al.

[11] Patent Number: 5,607,113

[45] Date of Patent: Mar. 4, 1997

[54] MIXER-GRINDER HAVING AN UPWARDLY ANGLED TROUGH

[75] Inventors: Gerald R. McGuffin, Sr., Coral Springs, Fla.; Aaron C. Gord, Dayton, Ohio; Raymond E. Guenther, Dayton, Ohio; Chris W. Snyder, Greenville, Ohio; Robert A. Arlt, Sr., Troy, Ohio

[73] Assignee: Premark FEG Corporation, Wilmington, Del.

[21] Appl. No.: 552,791

[22] Filed: Nov. 3, 1995

[51] Int. Cl.[6] ..... B02C 17/16

[52] U.S. Cl. ..... 241/82.1; 241/101.8; 366/194

[58] Field of Search ..... 366/297–300, 366/186, 194–196, 320, 325.92; 241/82.1–82.7, 101.8

[56] References Cited

U.S. PATENT DOCUMENTS

| | | | |
|---|---|---|---|
| 3,213,911 | 10/1965 | Seydelmann | 241/82.4 |
| 3,243,128 | 3/1966 | Tight | 241/65 |
| 3,310,086 | 3/1967 | Lasar | 241/82.1 |
| 3,450,179 | 6/1969 | Golding | 241/82.5 |
| 3,548,902 | 12/1970 | Holly | 241/282.1 X |
| 3,548,903 | 12/1970 | Holly | 366/186 X |
| 3,570,569 | 3/1971 | Hartley et al. | 366/186 X |
| 3,638,920 | 2/1972 | Davis | 366/298 |
| 3,653,420 | 4/1972 | Viene | 241/82.1 |
| 3,730,443 | 5/1973 | Johnson . | |
| 3,752,298 | 8/1973 | Wenger . | |
| 3,770,216 | 11/1973 | Holly . | |
| 3,795,369 | 3/1974 | Moser . | |
| 3,984,056 | 10/1976 | Hartley | 241/82.1 |
| 4,077,089 | 3/1978 | Dutaud . | |
| 4,422,582 | 12/1983 | Roeger et al. . | |
| 4,483,625 | 11/1984 | Fisher | 366/325.3 X |
| 4,736,896 | 4/1988 | Wagner . | |
| 4,978,077 | 12/1990 | Hebner et al. . | |

FOREIGN PATENT DOCUMENTS

| | | | |
|---|---|---|---|
| 2595266 | 9/1987 | France | 241/82.5 |
| 748220 | 10/1944 | Germany | 241/82.1 |
| 1049261 | 1/1959 | Germany | 241/82.4 |
| 124662 | 2/1949 | Sweden | 241/82.1 |
| 213624 | 5/1968 | U.S.S.R. | 241/82.1 |

*Primary Examiner*—Charles E. Cooley
*Attorney, Agent, or Firm*—Thompson Hine & Flory LLP

[57] ABSTRACT

The invention is a mixer-grinder for food processing. The unit is designed to provide both an ergonomically convenient position for the top of the hopper with respect to loading, for the discharge opening with respect to receiving the processed product and for the deepest point of the hopper with respect to cleaning. The apparatus includes a base; a hopper mounted on the base, the hopper being formed by a front wall, a rear wall and a curved bottom wall connecting the front wall and the rear wall; a trough formed in the bottom wall of the hopper; a discharge opening in the front wall at one end of the trough; a worm rotatably mounted in the trough for moving food toward the discharge opening; at least one paddle for mixing food in the hopper, the paddle being mounted on a rotatable shaft centrally positioned in the hopper; and a motor and transmission mounted on the base for driving the worm. The trough is preferably oriented such that a central axis thereof is upwardly inclined. Further, the invention includes a double wall transmission/hopper to ensure cleaning of the food contact areas.

20 Claims, 5 Drawing Sheets

MIXER-GRINDER HAVING AN UPWARDLY ANGLED TROUGH

BACKGROUND OF THE INVENTION

The present invention relates generally to food processing machines, such as a mixer-grinder, and more-particularly, to an food grinding apparatus with an ergonomically convenient design.

Mixer-grinders are routinely used in the preparation of ground meat and similar food products. Conventional mixer-grinders employ a hopper with a worm along the bottom of the hopper for moving the meat forwardly to a discharge opening. The meat is fed from the hopper to a grinding head which is at a low level. A horizontal feed is used to transport the food product. That is, the hopper is horizontal and the meat is extruded in a downward direction, fed by gravity.

Accordingly, there exists a need for an apparatus which adequately mixes and grinds a food product, has a dispensing end which is in an ergonomically convenient location, has a loading height which is ergonomically convenient and which is relatively easy and convenient to clean.

SUMMARY

The present invention is a mixing-grinding apparatus for grinding and mixing a food product comprising a base; a hopper mounted on the base, the hopper being formed with a front wall, a rear wall and a curved bottom wall connecting the front wall and the rear wall; a trough formed in the bottom wall of the hopper; a discharge opening in the front wall at one end of the trough; a worm rotatably mounted in the trough for moving the food toward the discharge opening; at least one paddle for mixing food in the hopper, the paddle being mounted on a rotatable shaft which extends between the front and rear walls of the hopper; and a motor mounted on the base for driving the worm; wherein, the hopper is mounted on the base such that the worm is upwardly inclined in the trough. The use of the upwardly inclined worm in the hopper facilitates the design of mixer-grinders which are ergonomically convenient to use.

Other objects and advantages of the present invention will be apparent from the following description, the accompanying drawings and the appended claims.

DETAILED DESCRIPTION OF THE PREFERRED EMBODIMENT

Figure 1:
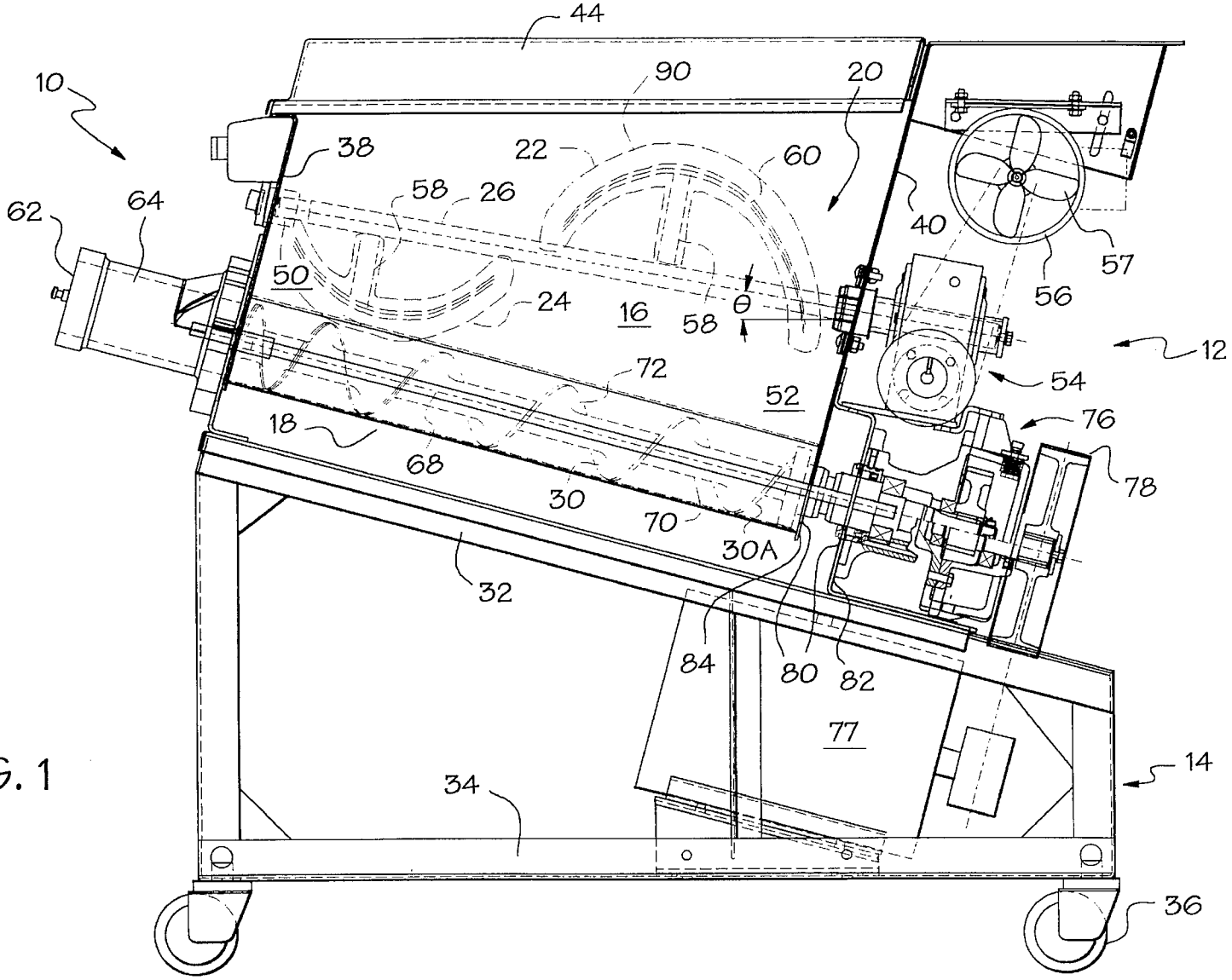
FIG. 1 is a side view of an ergonomic mixer-grinder according to the present invention.
Figure 3:
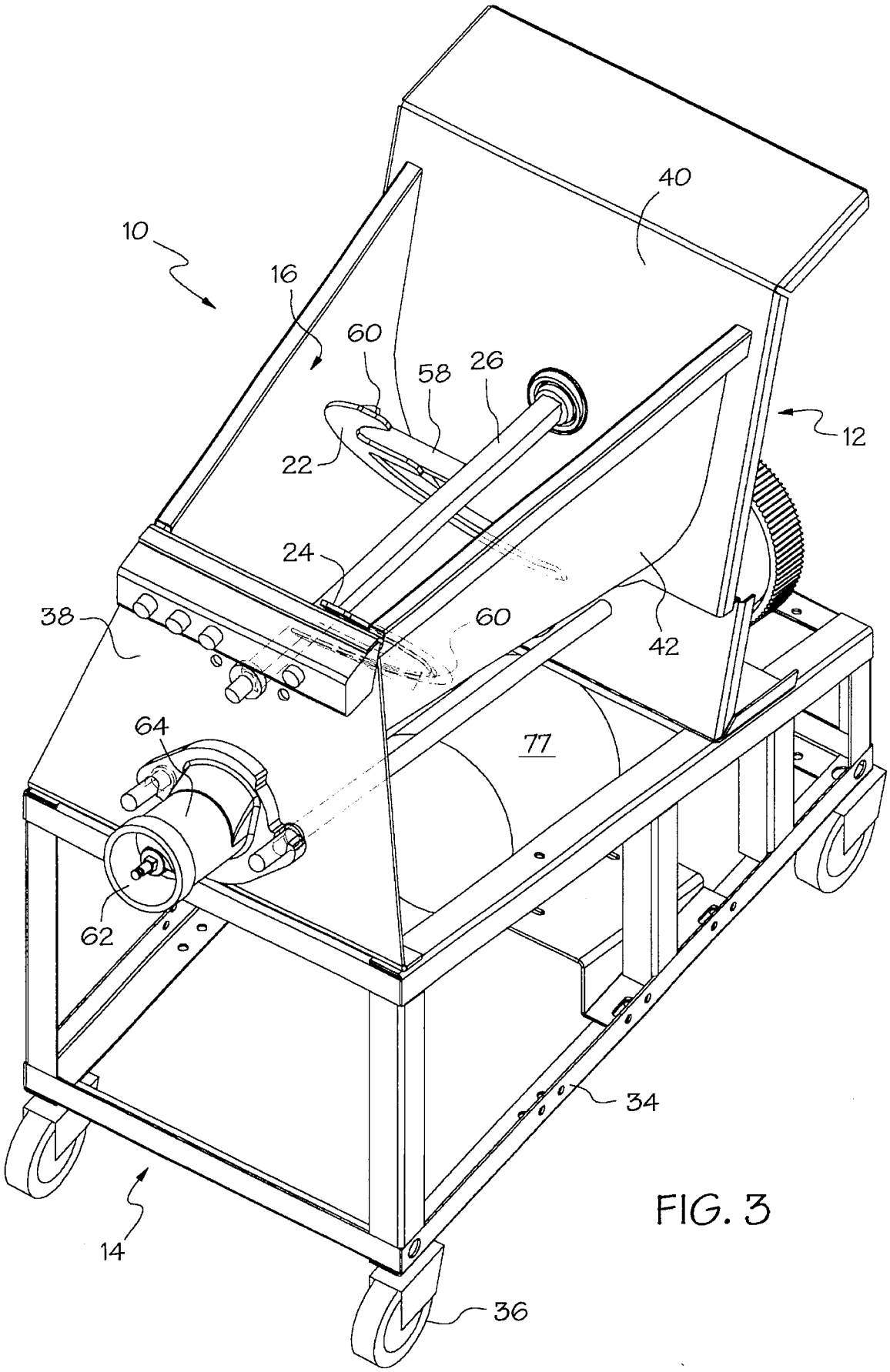
FIG. 3 is a perspective view of the mixer-grinder of FIG. 1.

FIGS. 1 and 3 disclose a mixer-grinder apparatus generally designated 10 which includes a body 12 and a base 14. The body 12 includes a hopper 16 having a well or trough 18 therein. Mixing takes place in the portion of the hopper generally designated 20 which includes a plurality of paddles 22, 24 carried on a shaft 26. The shaft 26 is either parallel or at an angle to the trough 18. The product is transported in the trough portion of the hopper which includes a worm 30 to a grinder head. The hopper 16 itself may be formed with generally U-shaped bottom and side walls having a cylindrical or conical curvature.

The base 14 is preferably a metal frame capable of supporting the mixer-grinder apparatus 10. The base includes an inclined top support frame 32 and a bottom frame 34 which is parallel to the horizontal. The base 14 includes four castered wheels 36 for ease in movability of the apparatus. In addition, the base may comprise four fixed legs for permanent installation. Further, the base and/or caster extensions can be made adjustable for proper leveling.

The body 12 of the apparatus includes hopper 16 which is defined by a front wall 38, a rear wall 40 and a curved bottom wall 42 which connects the front wall 38 and rear wall 40. The hopper 16 is open at the top, but is designed to include a hinged, detachable hopper lid 44, which includes appropriate interlocks to stop the worm and paddles when the lid is opened on the hopper.

Figure 2A:
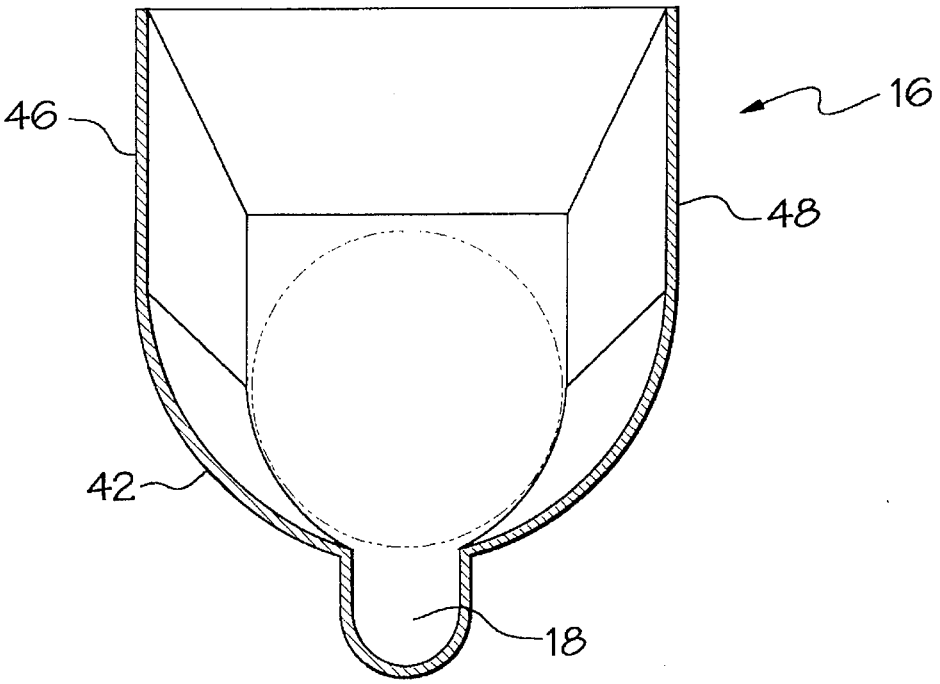
FIGS. 2(*a*) and 2(*b*) are two optional end views thereof.
Figure 2B:
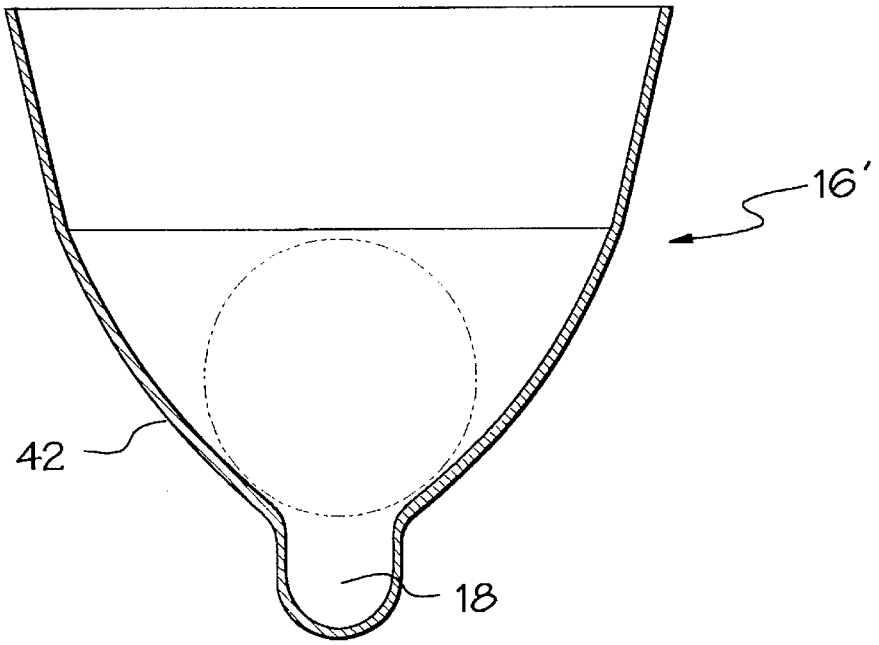

A cross-sectional view of the hopper shown in FIG. 2(*a*) has a conical curvature with vertical side wall portions 46,48. There is an angle where the side walls intersect the conical portion of the hopper 16. The vertical walls are advantageous because the food product has less tendency to adhere to them. The rear wall 40 of the hopper is not vertical but is perpendicular to the trough 18 containing the worm 30. The conical hopper 16 therefore sits on the base 14 at an angle.

Alternatively, the hopper 16 may have a cylindrical curvature as shown in FIG. 2(*b*). In this case, the vertical sidewall portions are not present. The cylindrical walls terminate at the top of the hopper. The cylindrical hopper has at constant radius of curvature which is offset or oriented at an angle with respect to horizontal to give it a "cone-like" appearance.

Figure 5:
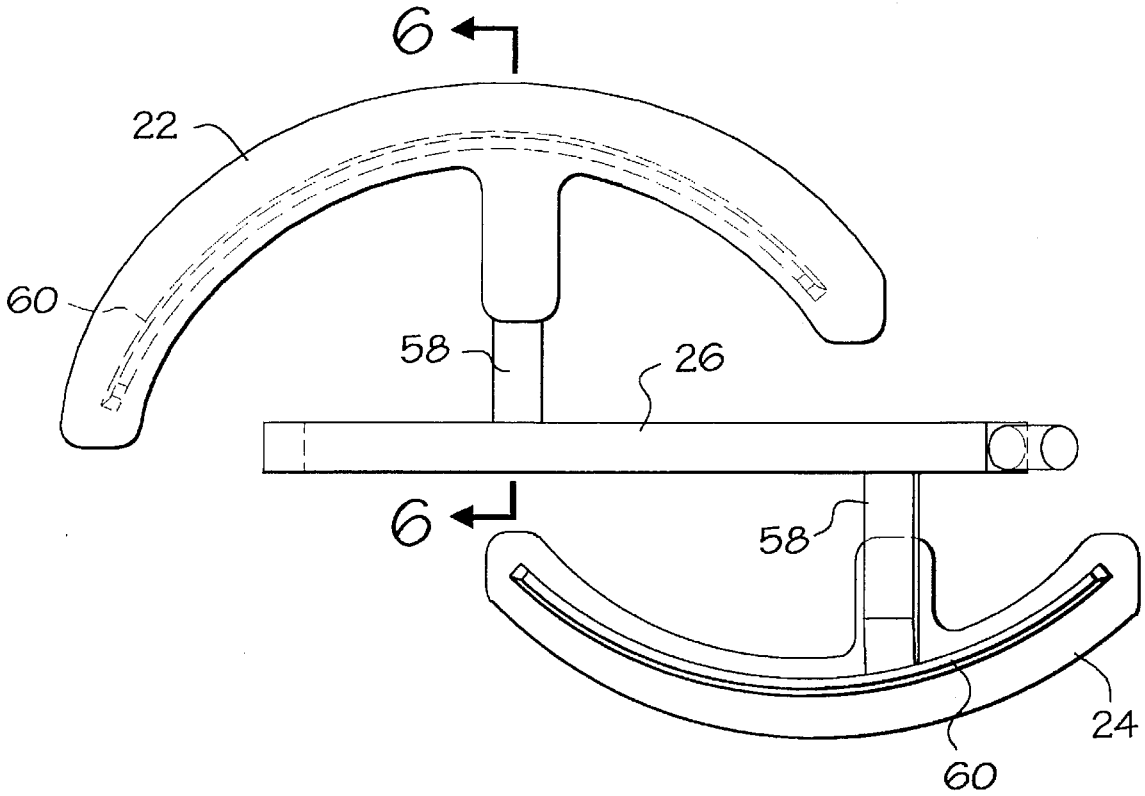
FIG. 5 is a detailed view of the paddles of FIG. 1.

As shown in FIG. 1, the front half (or portion adjacent the front wall) 50 of the hopper is mixed by the action of one paddle 24 while the rear portion of the hopper 52 is mixed with the second paddle 22. The paddles 22, 24 are fixedly mounted on a shaft 26 and are specifically designed to eliminate, or minimize as much as feasible, any "dead spots" wherein the meat is isolated and is not effectively mixed, while at the same time not over-working the meat during the mixing. In the illustrated embodiment, the paddles are designed with a substantially elliptical surface 90 and travel along a major portion of the interior surface of the hopper 16 as shown in FIG. 5. The elliptical shape of the paddles most closely corresponds to the interior of the hopper. When a conical body, such as a hopper, is cut at an angle with a plane, the intersection between the plane and the cone defines an ellipse. The substantially elliptical paddles therefore can mix the food product effectively by traveling in close proximity to a large area within the hopper as they are rotated and thus minimize dead spots. The paddles are oriented such that they provide a net axial thrust so that food is fed to the trough and worm and not lifted away.

The angle at which the plane of paddle intersect the shaft 26 ranges from about 15° to 75° depending on the volume size of the hopper. For example, in a hopper having a volume of 150 pounds, a 45° angle may be used. If this range is not used, it may Still be possible to achieve efficient mixing, by using three or four paddles.

The paddles 22,24 are mounted on shaft 26 such that they mix the meat with an opposing motion. The deepest paddle 22 moves the meat forward as the forward paddle 24 moves the meat back. The net effect of this action is one of folding top to bottom and back to front. The paddles 22,24 are rotated by the drive train 54 which is driven by the mixer motor 56. The paddles are preferably rotated at a speed of approximately 20 to 30 rpm. A fan 57 is also added for ventilation.

The axis 26 of the paddle shaft on which the paddles are mounted, is preferably in the center of the conical hopper 16. Preferably, the shaft 26 is at an angle θ to the horizontal. For the cylindrical hopper (FIG. 2(*b*)) it has been found desirable to mount the shaft at an angle of approximately 20° to horizontal and preferably, approximately 11° with respect to horizontal. However, this angle is an outcome which largely depends on the geometry of the chosen difference between loading and discharge height and the capacity of the hopper. In the conical hopper of FIG. 2(*a*), the paddle shaft 26 is mounted at an angle of approximately 20° to horizontal, and preferably approximately 7.5° to the horizontal for a 150 lb. hopper.

Figure 6:
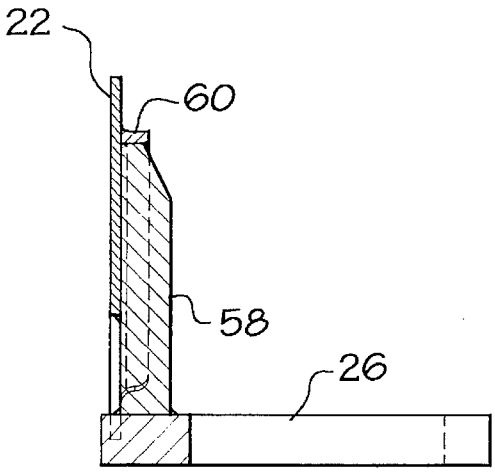
FIG. 6 is a cross-sectional view of the paddles of FIG. 5.

The shaft 26 of the apparatus 10 further includes mounting brackets 58 welded on to each of the paddles 22,24 at a right angle to the shaft 26. The mounting bracket 58 holds the substantially elliptical paddles at an angle to the shaft. The paddles as shown in FIG. 3, are also equipped with conventional backing bars 60 (as shown in cross-section in FIG. 6) for reinforcement in order to stiffen the paddles so that they do not easily bend or break. These backing bars follow the shape of the paddles and are welded thereto.

The mixer-grinder 10 includes a discharge opening 62 in the front wall 38 of the hopper. The discharge opening 62 preferably includes a grinding head 64. This grinding head may be the head described in commonly owned U.S. Pat. No. 4,422,582 to Roeger, et al. The grinding head 64 is mounted at the same angle as the worm and fits flush on the hopper.

The trough portion 18 is semicircular and formed into the curved bottom wall 42 of the hopper. The trough 18 is oriented such that its center axis 68 is upwardly inclined to the discharge opening 62. In a 150 pound mixer, the worm trough 18 is preferably at an angle of approximately 15° with respect to horizontal. As discussed later, to maintain the ergonomically convenient positions of the grinder head 64 and the deepest point in the hopper, the angle of the trough may range from 10° to 25°.

The worm 30 is rotatably mounted in the trough 18 of the hopper. The worm 30 includes a shaft 70 and a series of flights 72 carried on the shaft 70. A typical worm may have a 6 inch forward pitch which gradually slows to approximately 2 inch forward pitch as it advances from the rear wall to the front wall. The flights 72 extend past the front wall 38 into the grinder head 64.

The worm 30 is driven by the transmission 76 (mounted to first wall 82) which is driven by pulley 78 which, in turn, is driven by motor 77. The worm 30 is preferably driven at a speed of approximately 195 to 230 rpm. The food product is thereby transported along the trough 18 to the discharge opening 62.

Figure 4:
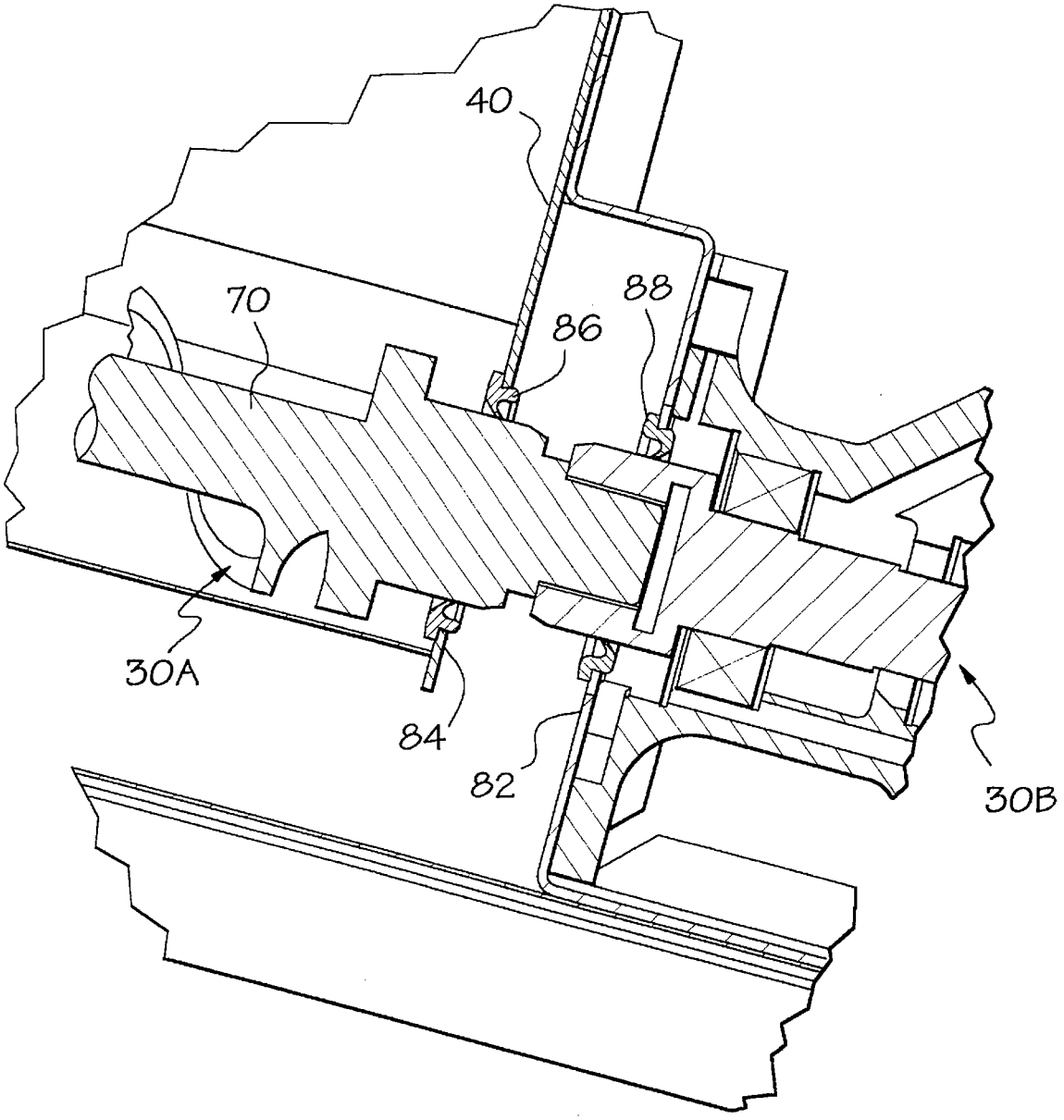
FIG. 4 is a detailed drawing of FIG. 1 showing the double wall construction.

The hopper 16 preferably includes an advantageous double wall construction 80 along the back wall 40 of the hopper as shown in detail in FIG. 4. The drive for the worm 30*b* is situated behind a first wall 82 and the food contacting portion 30*a* of the worm sits in front of a second wall 84. A seal 86,88 is provided in each wall 82,84 as shown in FIG. 4. This prevents transmission fluid from the drive machinery from contaminating the food product or any of the food product clogging the drive machinery. The double wall construction also ensures that the seals 86,88 removed from the walls will not be contaminated, and therefore can be easily cleaned and sanitized. The seal mounting area is easily reached from both sides of the rear wall 40 for cleaning and sanitizing and quick, easy removal and installation of the seal.

The height of the discharge opening 62 at the grinding head can be altered by changing the height of the base 14 and the angle of the trough and hopper. The hopper 16 is at a height on the base 14 and the worm 30 is inclined such that the discharge opening 62 is at an ergonomically convenient height. The term "ergonomically convenient" is used with respect to three dimensions. First, locating the height of the discharge opening to facilitate receiving the ground food product at approximately knuckle height. Second, limiting the height of the top edge of the hopper to facilitate filling the hopper. Third, keeping the deepest portion of the hopper within reach to facilitate cleaning.

The mixer-grinder 10 is preferably designed around the median height and reach of the population. Once the height of the discharge opening and top of the hopper are fixed, the deepest point of the hopper is preferably located to facilitate cleaning. The length of the hopper can be adjusted to provide a 60–250 pound capacity while keeping these ergonomically defined coordinates, resulting in a family of mixer-grinders with similar features but having different capacities. The top of the hopper is about 30 to 50 inches above the floor and preferably 40 to 48 inches. The discharge opening is approximately 30 to 35 inches from the floor. The deepest point of the hopper is about 16 to 25 inches off the floor and 16 to 25 inches below the top of the hopper. Preferably, these dimensions should stay within these ranges regardless of the capacity of the hopper.

As stated above, the mixer-grinder 10 includes a motor drive train 54 for rotating the mixing paddles 22,24 within the hopper 16 and the transmission 76 for rotating the worm 30 in the trough 18. Although the apparatus is shown with separate motors 56 and 77 for driving the paddles and worm, those of skill in the art will appreciate that a single motor could be used. However, if a single motor is used, a clutch would be required to accommodate the differing actions of the paddles 22,24 and the worm 30.

The apparatus 10 preferably includes a cover 44 over the top of the hopper. Electrical interlocks can be provided so that when the cover 44 is lifted, the drives of the mixing shaft and the screw shut off.

To use the mixer-grinder apparatus 10 of the present invention, a user opens the hopper lid 44 and inserts the food product (not shown). When the lid 44 is replaced, the mixer-grinder 10 may be turned on by the operator. The paddles 22,24 mix the food product, as well as feed the food product to the trough 18 of the hopper. In the trough, the food product is transported upwardly by the action of the worm 30 to the discharge opening 62 in the front wall 38 of the hopper. At the discharge opening the food product is cut and extruded from the apparatus through the cylinder head 64 to the user.

Having described the invention in detail and by reference to preferred embodiments thereof, it will be apparent that modifications and variations are possible without departing from the scope of the invention defined in the appended claims.

What is claimed is:

1. A mixing-grinding apparatus for grinding and mixing a food product comprising:

a base;

a hopper mounted on the base, the hopper being formed by a front wall, a rear wall and a curved bottom wall connecting the front wall and the rear wall, and being open at the top;

a trough formed in the bottom wall of the hopper;

a discharge opening in the front wall of the hopper in alignment with and at one end of the trough;

a worm rotatably mounted in the trough; and at least one paddle for mixing food in the hopper, the at least one paddle being mounted on a rotatable shaft extending from the rear wall to the front wall of the hopper; and a grinding head mounted on the front wall of the hopper at the discharge opening;

wherein, the trough is upwardly inclined.

2. The apparatus of claim 1 wherein the bottom wall includes a lower portion and an upper portion, such that the lower portion is substantially conical and the upper portion comprises two substantially vertical planar walls.

3. The apparatus of claim 2 wherein there are two paddles on the shaft which are shaped such that the food product is effectively mixed.

4. The apparatus of claim 3 wherein a first paddle mixes the food in the rear of the hopper and the second paddle mixes the food in the front of the hopper in order to move the food product fore and aft without overworking.

5. The apparatus of claim 1 wherein the bottom wall is semi-cylindrical in shape.

6. The apparatus of claim 1 wherein the discharge opening is at an ergonomically convenient height.

7. The apparatus of claim 1 wherein the hopper has an opening and the apparatus is designed such that the height of the hopper opening is at an ergonomically convenient height for filling of the hopper with a food product.

8. The apparatus of claim 7 further comprising a motor and a transmission mounted on the apparatus for driving the worm and the at least one paddle.

9. The apparatus of claim 1 wherein the deepest point of the hopper is at an ergonomically convenient height.

10. The apparatus of claim 1 wherein the trough is inclined at an angle of approximately 15° from horizontal.

11. The apparatus of claim 1 wherein the rotatable shaft is mounted at an angle of approximately 20° from horizontal to approaching horizontal.

12. The apparatus of claim 11 wherein the worm has a pitch which decreases as it approaches the discharge opening.

13. The apparatus of claim 1 wherein the hopper is mounted on the base at a height and inclined such that the discharge opening is at an ergonomically convenient height.

14. The apparatus of claim 1 wherein the hopper includes a double-wall construction such that a drive portion of the worm is behind a first wall and a food contacting side of the worm sits in front of a second wall.

15. The apparatus of claim 14 wherein each wall of the double wall construction includes a seal to prevent fluid from the drive portion of the worm from contaminating the food and the food from clogging the drive portion.

16. A mixing-grinding apparatus for grinding and mixing a food product comprising:

a base;

a hopper mounted on the base, the hopper being formed by a front wall, a rear wall and a curved bottom wall connecting the front wall and the rear wall, and being open at the top;

a trough formed in the bottom wall of the hopper;

a discharge opening in the front wall of the hopper in alignment with and at one end of the trough;

a worm rotatably mounted in the trough, the worm being able to feed upwardly and having a pitch which decreases as it approaches the discharge opening;

at least one paddle for mixing food in the hopper, the at least one paddle being mounted on a rotatable shaft centrally position in the hopper;

a motor and transmission mounted on the base for driving the worm; and a grinding head mounted on the front wall of the hopper at the discharge opening;

wherein, the apparatus is designed such that the height of the hopper opening is at an ergonomically convenient height and the trough is oriented such that a central axis thereof is upwardly inclined, and the discharge opening is at an ergonomically convenient height and wherein the deepest point of the hopper is at an ergonomically convenient height to facilitate cleaning.

17. The apparatus of claim 16 wherein the bottom wall includes a lower portion and an upper portion, such that the lower portion is substantially conical and the upper portion comprises two substantially vertical planar walls.

18. The apparatus of claim 16 wherein the bottom wall is semi-cylindrical in shape.

19. The apparatus of claim 16 wherein the trough is inclined at an angle of approximately 15° from the horizontal and the shaft is mounted at an upward angle from the horizontal.

20. The apparatus of claim 16 wherein the at least one paddle is substantially elliptical in shape.

* * * * *